US008191299B2

(12) United States Patent
Faifer

(10) Patent No.: US 8,191,299 B2
(45) Date of Patent: Jun. 5, 2012

(54) FIREARM STOCK

(76) Inventor: Tuvia Faifer, Mishmar Hashiva (IL)

( * ) Notice: Subject to any disclaimer, the term of this patent is extended or adjusted under 35 U.S.C. 154(b) by 310 days.

(21) Appl. No.: 12/558,613

(22) Filed: Sep. 14, 2009

(65) Prior Publication Data

US 2010/0115817 A1 May 13, 2010

Related U.S. Application Data

(60) Provisional application No. 61/099,219, filed on Sep. 23, 2008.

(51) Int. Cl.
*F41C 23/00* (2006.01)
*B23P 17/00* (2006.01)

(52) U.S. Cl. ..... 42/71.01; 29/592

(58) Field of Classification Search ..... 42/71.01, 42/71.02, 72, 73, 74; 29/592
See application file for complete search history.

(56) References Cited

U.S. PATENT DOCUMENTS

| | | | | |
|---|---|---|---|---|
| 4,316,342 | A * | 2/1982 | Griggs | 42/74 |
| 4,936,036 | A * | 6/1990 | Sniezak et al. | 42/71.02 |
| 5,031,348 | A * | 7/1991 | Carey | 42/74 |
| 6,651,371 | B2 * | 11/2003 | Fitzpatrick et al. | 42/72 |
| 6,732,466 | B2 * | 5/2004 | Bentley | 42/74 |
| 6,925,744 | B2 * | 8/2005 | Kincel | 42/71.01 |
| 7,162,822 | B1 * | 1/2007 | Heayn et al. | 42/73 |
| 2007/0033850 | A1 * | 2/2007 | Murello et al. | 42/71.01 |
| 2007/0137087 | A1 * | 6/2007 | Florea et al. | 42/90 |
| 2009/0300963 | A1 * | 12/2009 | Hines | 42/75.03 |

* cited by examiner

*Primary Examiner* — Bret Hayes
(74) *Attorney, Agent, or Firm* — Deborah Gador

(57) ABSTRACT

A firearm stock having a buffer tube holder, the buffer tube holder including a bore for receiving a buffer tube, and at least one flexible support member defined in the bore for engaging and firmly holding the buffer tube. Preferably, the flexible support member includes a U-shaped slot defining a flexible flap.

10 Claims, 3 Drawing Sheets

FIREARM STOCK

RELATED APPLICATIONS

The present invention claims the benefit of U.S. Provisional Application 61/099,219 filed 23 Sep. 2008.

FIELD OF THE INVENTION

The present invention relates to firearm stocks, in general and, in particular, to a replaceable firearm stock having a buffer tube holder.

BACKGROUND OF THE INVENTION

Firearm stocks tend to make noise when carried by a shooter. Noises are generated by small displacements of the parts of firearm stock against each other. In particular, the firearm often includes a buffer tube in a buffer tube holder that usually are not perfectly matched to one another. When the firearm is moved, particularly during walking or running, there are slight movements of the buffer tube and the buffer tube holder relative to each other and when they collide, noise is generated. Such noises can be very problematic in the field and in battle.

Accordingly, there is a long felt need for a stock which avoids or mitigates noises that a firearm emits when carried.

SUMMARY OF THE INVENTION

There is provided according to the present invention a stock including elements for reducing noises emitted from a firearm while it is carried by a user.

In particular, there is provided a firearm stock having a buffer tube holder, the buffer tube holder including a bore for receiving a buffer tube, and at least one flexible support member defined in the bore for engaging and firmly holding the buffer tube.

According to a preferred embodiment, the flexible support member includes a U-shaped slot defining a flexible flap.

There is also provided according to the invention, a method for making a firearm stock including forming a bore for receiving a buffer tube in a stock, and forming at least one flexible support member in the bore for engaging and firmly holding the buffer tube.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a replaceable firearm stock having a buffer tube holder. The buffer tube holder includes flexible support members for firmly holding the buffer tube mounted therein. The flexible support members permit the mounting of buffer tubes of slightly varying diameters while preventing small movements in the buffer tube holder that cause noise when the firearm is moved.

Figure 3:
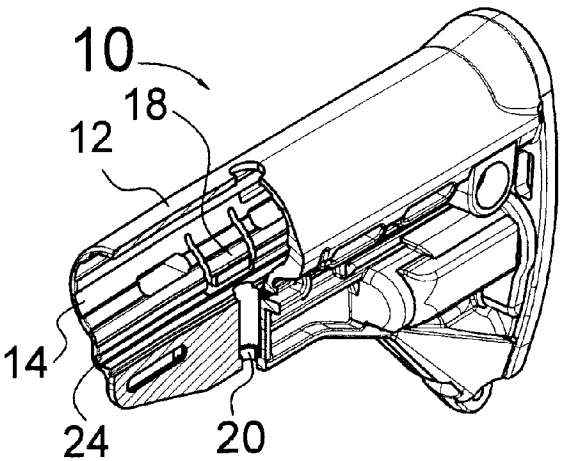
FIG. 3 is a partially cut-away perspective view illustration of the firearm stock of FIG. 1.
Figure 1:
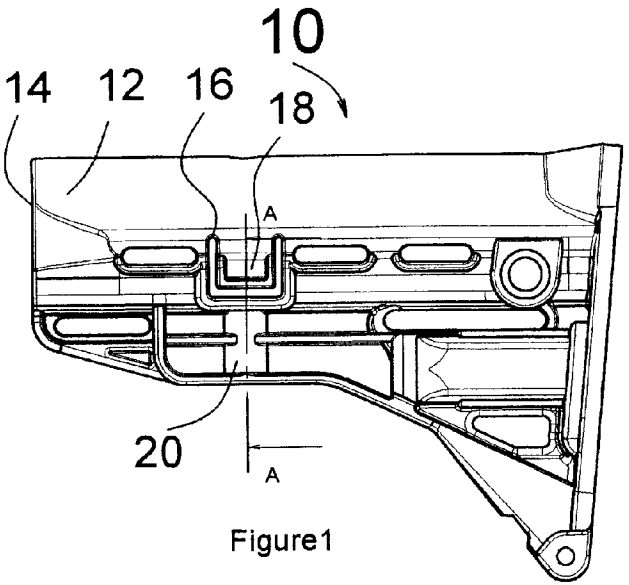
FIG. 1 is a side view illustration of a firearm stock, constructed and operative in accordance with one embodiment of the present invention.
Figure 2:
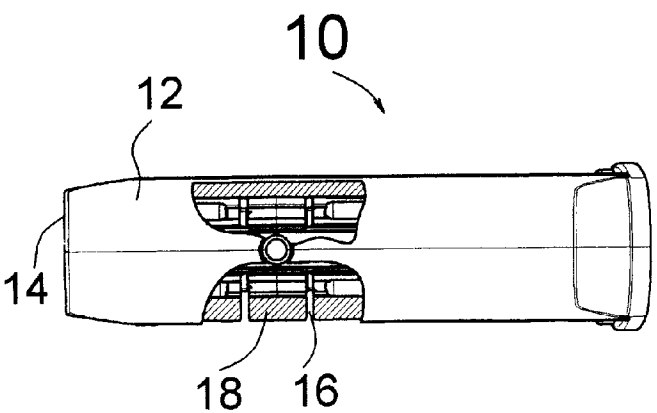
FIG. 2 is partially cut-away top view illustration of the firearm stock of FIG. 1.

Referring to FIGS. 1 to 3, there are shown schematic side, partially cut-away top, and partially cut-away perspective views, respectively, of a firearm stock 10 constructed and operative in accordance with one embodiment of the present invention. Firearm stock 10 includes a buffer tube holder 12 which is substantially a cylindrical member having a bore 14 for receiving a buffer tube. Bore 14 further includes a track 24 for receiving the buffer tube rail, as known.

Buffer tube holder 12 includes at least one, and preferably two, buffer tube support members 18 in its side walls. In the illustrated embodiment, support members 18 are flaps defined by a U shaped slot 16, preferably, one on each side wall of buffer tube holder 12. Buffer tube holder 12 is made of a somewhat flexible material so as to provide flap 18 with a restoring force toward the inside of buffer tube holder 12. Flaps 18 serve to engage and firmly hold a buffer tube within buffer tube 12, substantially preventing small relative movements between the buffer tube and the buffer tube holder.

Firearm stock 10 further includes a locking groove 20 vertically positioned underneath bore 14. Locking groove 20 receives a locking pin (not shown), which is further pushed against the buffer tube to secure it against the upper wall of buffer tube holder 12, as known.

Figure 5:
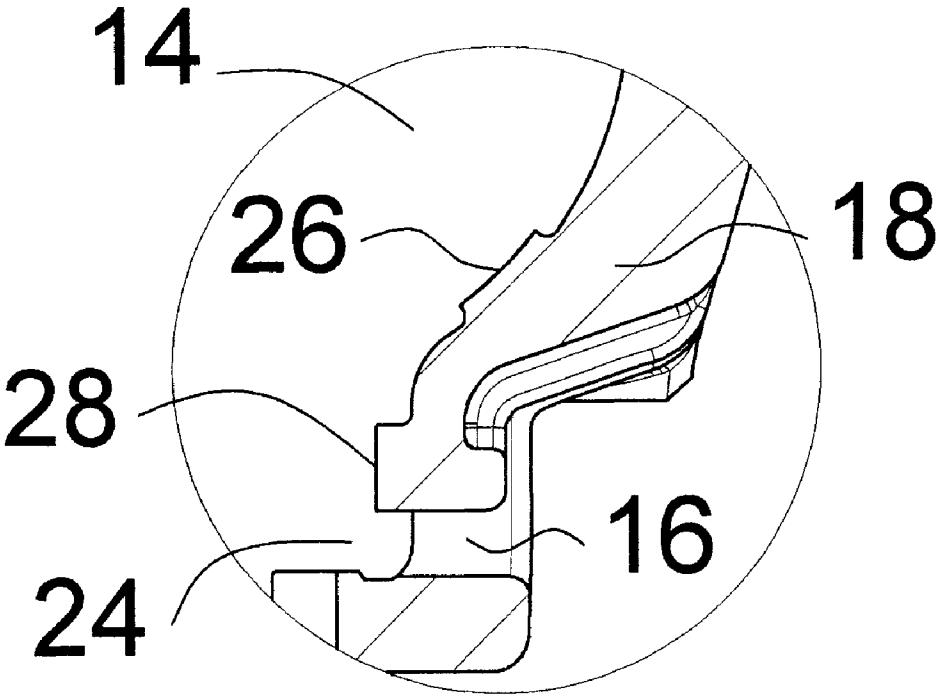
FIG. 5 is an enlarged view of a portion of FIG. 4.
Figure 4:
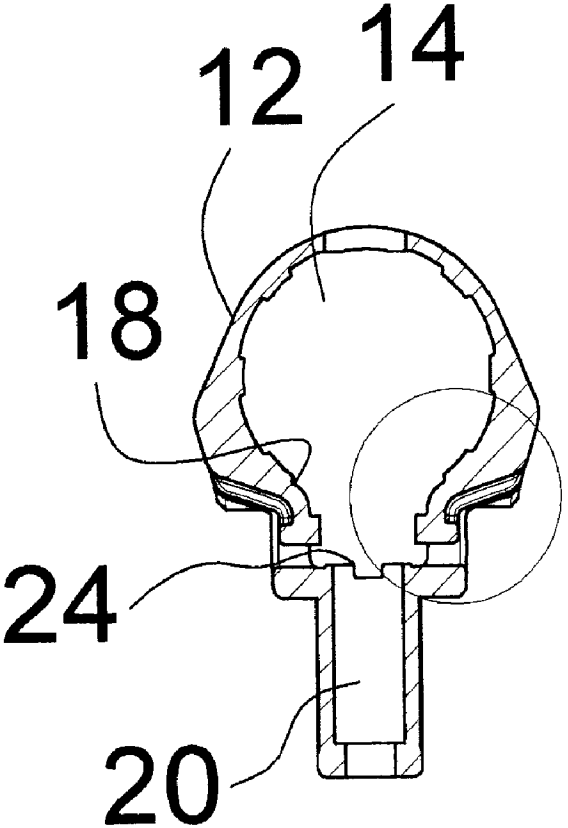
FIG. 4 is a front sectional view taken along line A-A of the firearm stock of FIG. 1.

FIG. 4 is a sectional view of firearm stock 10 taken along line A-A in FIG. 1 through flaps 18. The inside wall of each one of flaps 18 includes two pads 26, 28, seen most clearly in FIG. 5, an enlarged view of a detail of FIG. 4. Pad 26 engages the side of a buffer tube and pad 28 engages the buffer tube rail. When a buffer tube is inserted into bore 14 of the buffer tube holder, flaps 18 provide additional support to the buffer tube and reduce unwanted relative movements of the buffer tube in the holder. Due to the flexible nature of buffer tube holder 12, flaps 18 can open outwardly slightly to permit a buffer tube to be mounted into bore 14, and return to snugly engage the sides of the buffer tube.

Figure 7:
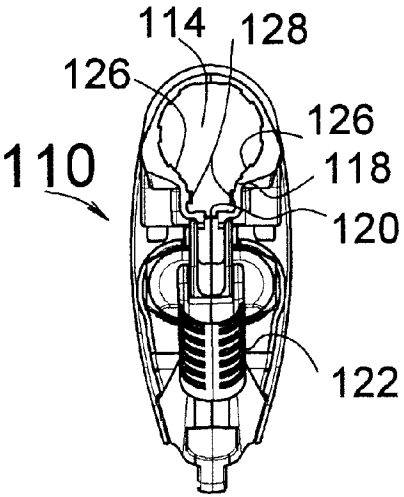
FIG. 7 is a front view of the firearm stock of FIG. 6.
Figure 6:
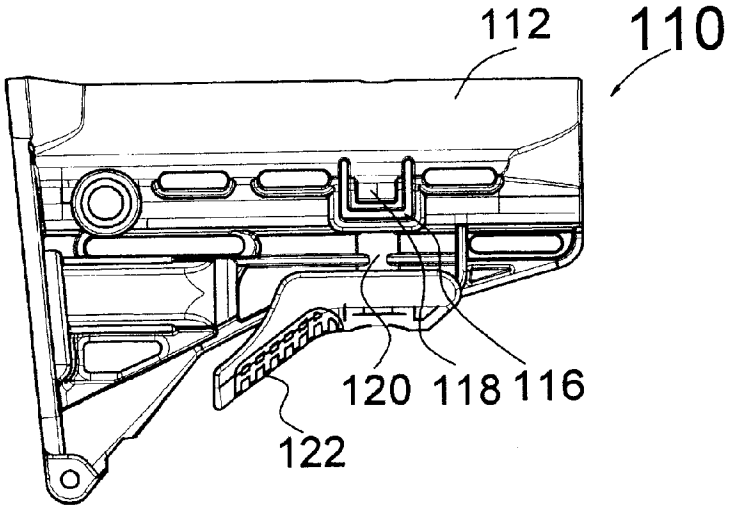
FIG. 6 is a side view of a firearm stock according to a preferred embodiment of the invention.
Figure 8:
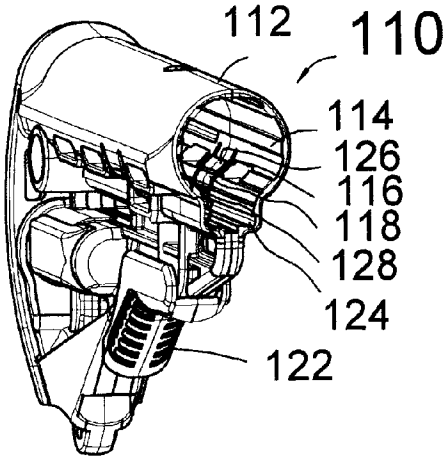
FIG. 8 is a perspective front view of the firearm stock of FIG. 6.

FIGS. 6-8 are side, front and perspective views, respectively, of a stock 110 according to a preferred embodiment of the invention. Firearm stock 110 includes a buffer tube holder 112 which is substantially a cylindrical member having a bore 114 for receiving a buffer tube. Bore 114 further includes a track 124 for receiving the buffer tube rail, as known.

Buffer tube holder 112 includes at least one, and preferably two, buffer tube support members 118 in its side walls. In the illustrated embodiment, support members 118 are flaps defined by a U shaped slot 116, preferably, one on each side wall of buffer tube holder 112. Buffer tube holder 112 is made of a somewhat flexible material so as to provide flap 118 with a restoring force toward the inside of buffer tube holder 112. Flaps 118 serve to engage and firmly hold a buffer tube within buffer tube 112, substantially preventing small relative movements between the buffer tube and the buffer tube holder.

Firearm stock 110 further includes a locking groove 120 vertically positioned underneath bore 114. Locking groove 120 receives a locking pin (not shown), which is further pushed, by means of a pivoting handle 122 against the buffer tube to secure it against the upper wall of buffer tube holder 112, as known.

The inside wall of each one of flaps 118 includes two pads 126, 128, seen most clearly in FIG. 7. Pad 126 engages the side of a buffer tube and pad 128 engages the buffer tube rail. When a buffer tube is inserted into bore 114 of the buffer tube holder, flaps 118 provide additional support to the buffer tube and reduce unwanted relative movements of the buffer tube in the holder. Due to the flexible nature of buffer tube holder 112, flaps 118 can open outwardly slightly to permit a buffer tube to be mounted into bore 114, and return to snugly engage the sides of the buffer tube.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A firearm stock having a buffer tube holder, the buffer tube holder comprising:

a bore for receiving a buffer tube having sides and a buffer tube rail; and at least one flexible support member defined in said bore opening outwardly slightly to permit a buffer tube to be mounted into said bore, and returning to snugly engage sides of a buffer tube in the bore preventing relative movement between the buffer tube and the bore;

wherein said at least one flexible support member includes a slot defining a flexible flap.

2. The firearm stock according to claim 1, further comprising a pad on said at least one flexible flap for engaging a side of a buffer tube.

3. The firearm stock according to claim 1, further comprising:

a second flexible support member including a slot defining a second flexible flap; and a pad on each said flap for engaging another side of the buffer tube.

4. The firearm stock according to claim 1, further comprising a pad on each said flap for engaging a buffer tube rail.

5. The firearm stock according to claim 1, further comprising a pad on said at least one flexible support member for engaging a buffer tube rail in said bore.

6. A method for making a firearm stock, the method comprising:

forming a buffer tube holder including a bore for receiving a buffer tube in a firearm stock; and forming at least one flexible support member said flexible support member opening outwardly slightly to permit a buffer tube to be mounted into said bore, and returning to snugly engage sides of a buffer tube in said bore preventing relative movement between the buffer tube and the bore;

wherein said step of forming at least one flexible support member includes forming at least one slot in said buffer tube holder defining a flexible flap.

7. The method according to claim 6, wherein said step of forming at least one flexible support member for engaging a buffer tube includes forming a flexible flap including at least one pad, said pad arranged to engage a side of a buffer tube.

8. The method according to claim 6, wherein said step of forming at least one slot includes forming a U-shaped slot defining a flexible flap including a pad for engaging a side of a buffer tube.

9. The method according to claim 6, wherein said step of forming at least one slot includes forming a U-shaped slot defining a flexible flap including a pad for engaging a buffer tube rail on a buffer tube.

10. A firearm stock having a buffer tube holder, the buffer tube holder comprising:

a bore for receiving a buffer tube having sides and a buffer tube rail; and at least one flexible support member defined in said bore opening outwardly slightly to permit a buffer tube to be mounted into said bore, and returning to snugly engage sides of a buffer tube in the bore preventing relative movement between the buffer tube and the bore;

wherein said at least one flexible support member includes a U-shaped slot defining a flexible flap.

* * * * *